United States Patent [19]

Moscrip

[11] Patent Number: 4,953,440

[45] Date of Patent: Sep. 4, 1990

[54] LIQUID MONOPROPELLANT GUN

[75] Inventor: William M. Moscrip, Fredericksburg, Va.

[73] Assignee: The United States of America as represented by the Secretary of the Navy, Washington, D.C.

[21] Appl. No.: 636,342

[22] Filed: Nov. 26, 1975

[51] Int. Cl.[5] ..... F41F 1/04

[52] U.S. Cl. ..... 89/7; 89/8

[58] Field of Search ..... 89/8, 7; 73/167; 60/39.46 M

[56] References Cited

U.S. PATENT DOCUMENTS

| | | | |
|---|---|---|---|
| 484,010 | 10/1892 | Haskell | 89/8 |
| 2,787,120 | 4/1957 | Leduc | 60/263 |
| 3,044,363 | 7/1962 | Musser | 89/8 |

FOREIGN PATENT DOCUMENTS

| | | | |
|---|---|---|---|
| 919369 | 9/1946 | France | 89/9 |

*Primary Examiner*—David H. Brown

*Attorney, Agent, or Firm*—John D. Lewis; Kenneth E. Walden

[57] ABSTRACT

A gun in which the interior wall of the breech portion of the bore is provided with a series of small annular combustion chambers distributed along the axis which are filled with liquid monopropellant to provide a propellant lined breech. Propellant is pumped into the annular combustion chambers through ports or fill orifices which communicate with an annular chamber surrounding the breech. This construction of the propellant in a series of small discrete volumes which eliminates the hydrodynamic instabilities associated with combustion of bulk loaded liquid propellants.

6 Claims, 1 Drawing Sheet

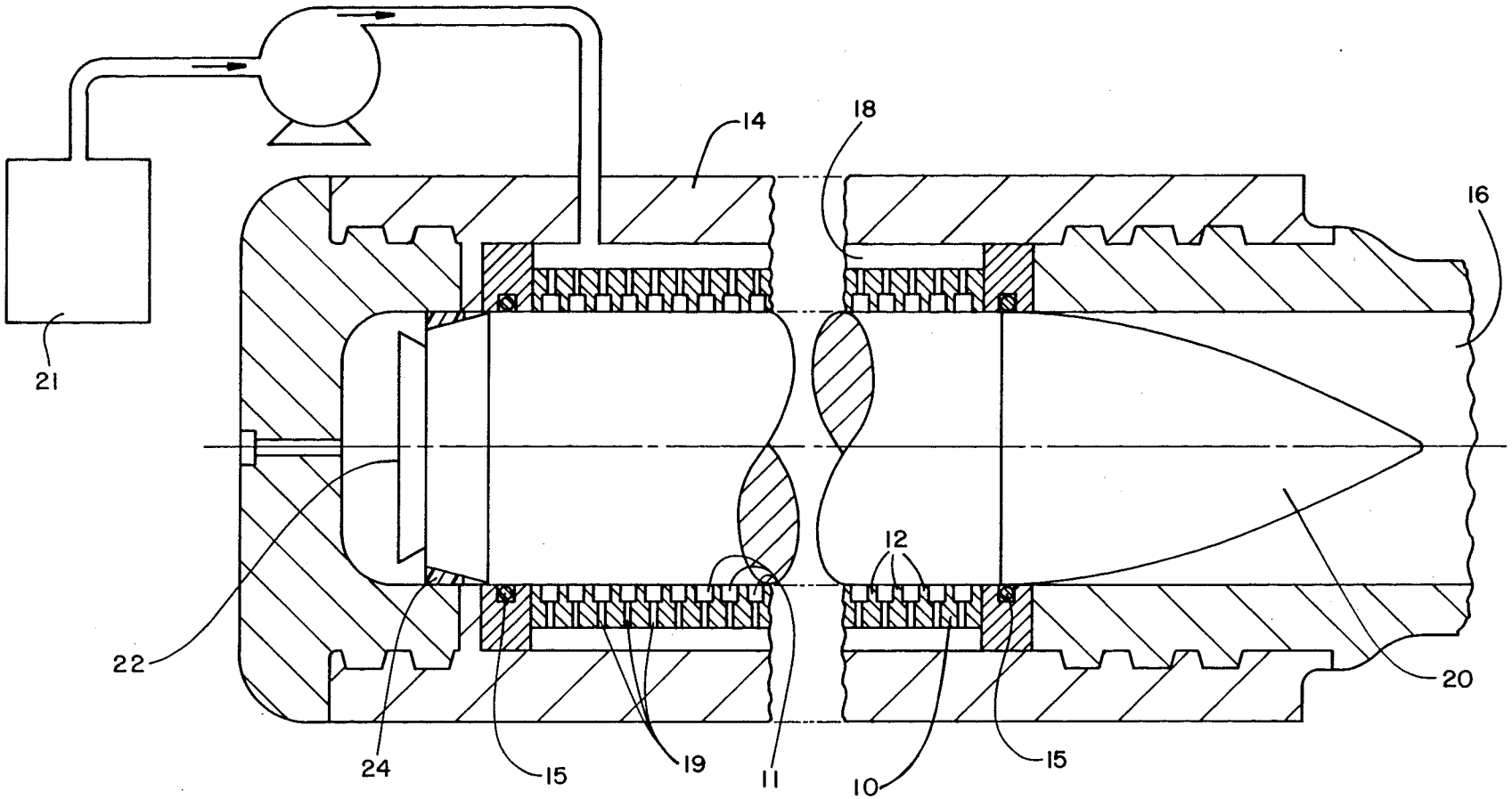
16
20
15
12
10
18
11
14
19
15
24
22
21

LIQUID MONOPROPELLANT GUN

BACKGROUND OF THE INVENTION

This invention relates generally to liquid propellant guns and more particularly to liquid monopropellant guns in which the breech is lined with propellant that is sequentially ignited in a discrete series of small volumes.

The design of a practicable gun weapon system based on the utilization of liquid propellants has been for at least twenty-five years a recurring, but elusive, goal of modern ordnance technologists. The following is quoted from a recent book ["Ignition! An Informal History of Liquid Rocket Propellants," Rutgers University Press, 1972], by Dr. John D. Clark, a noted authority and pioneer in the development of liquid propellants:

"Even a low-energy monopropellant has more energy in it per gram than does smokeless ball powder, and a great deal more energy per cubic centimeter. (A liquid is much more closely packed than a heap of small grains.) So, if a liquid propellant were used, either packaged in the cartridge as the solid propellant is, or pumped separately into the gun chamber behind the bullet, it should be possible to get a much higher muzzle velocity without any increase in weight. Hydrazine-hydrazine nitrate-water mixtures have been the usual propellants in the liquid gun programs, although NPN sometimes mixed with ethyl nitrate, has been running, on and off, since about 1950, but have never been carried through. The military demands a weapon, programs are started and run for a few years, then money or interest runs out, and the whole thing ends, only to start all over five or six years later. I've seen three cycles since I got into the business. JPL, Olin Mathieson, Detroit Controls, as well as various Army and Air Force installations, have been involved. The main problems are more in the engineering than in the chemistry."

The one unequivocal disadvantage which continues to prevent the exploitation of liquid monopropellants in guns is that they are characterized by an unstable, unpredictable, and heretofore uncontrollable combustion process. In bulk loaded liquid monopropellant guns this factor has inevitably produced high and erratic combustion pressures which damage the guns, cause erratic behavior of gas operated weapons, and result in large muzzle velocity variations. It has been shown theoretically and confirmed experimentally that gross hydrodynamic instabilities characterize the normal behavior of bulk loaded liquid propellants in a gun environment. Extensive theoretical treatments of known types of hydrodynamic instabilities believed to be present, viz. the Taylor and Helmholtz instabilities, has served to confirm the fact that the combustion process of bulk loaded liquid monopropellants in a gun cannot be easily controlled.

Current technical approaches to the development of new liquid propellant gun weapon systems, particularly those intended for naval surface warfare, are directed toward the use of bulk load liquid monopropellants for reasons of safety and logistics. The central technical problem to be solved continues to be the requirement for a feasible means of controlling the combustion process to achieve reliable gun interior ballastics. In the search for a solution to this problem the present invention provides an approach which embodies a mechanically controlled combustion process rather than one which relies on natural hydrodynamic processes. It is believed that such an approach can provide a practicable liquid monopropellant gun which avoids altogether the enormously complex and analytically intractable hydrodynamic phenomena associated with previous bulk loaded liquid propellant guns.

SUMMARY OF THE INVENTION

To successfully control the burning of aliquid monopropellant in the gun environment one must quantify the burning surface area as a function of time. This is accomplished by dividing the propellant into a large number of discrete small volumes which independently present a small surface area to be burned. Then as each small volume is successively ignited in sequence behind the moving projectile and the combustion of each is forced to proceed mechanically independent from the others, the instabilities associated with bulk liquid combustion are automatically precluded. The burning surface area development in time thus becomes a function of the ignition sequence which is directly coupled to the motion of the projectile in the bore. This approach establishes conditions under which the propellant gas production rate becomes a precisely metered function of the projectile mass (a constant), and thereby ensures high reproducibility and optimum piezometric efficiency to the firing impulse.

BRIEF DESCRIPTION OF THE DRAWING

The single FIGURE of the drawing is a sectional view illustrating the principal features of the present invention.

DESCRIPTION OF THE PREFERRED EMBODIMENT

This invention can be considered in some respects to be an extension of the fundamental concepts outlined in the copending application of the present inventor, Ser. No. 626,675, filed Oct. 28, 1975. The gun disclosed in the aforementioned copending application achieves an optimum interior ballistics system by lining a portion of the bore surface with a single solid propellant grain, with respect to which the burning surface area development is controlled directly by the motion of the projectile. The utilization of solid propellant in this manner results in an optimum piezometric efficiency and a precision firing impulse, but necessitates the replacement of the breech portion of the gun between each shot—a natural condition for the expendable breech gun. The present invention achieves an analogous effect using liquid monopropellant to create a propellant lined breech, which will be relined by pumping fresh propellant into a specially designed chamber between shots.

This can be accomplished by constructing the gun in the general configuration shown in the drawing. The gun comprises a generally cylindrical breech 10 having a plurality of annular combustion chambers 11 formed in the interior thereof and defined by a plurality of annular flanges 12 formed integrally with the breech 10. The breech 10 is supported within a jacket 14 by means of a pair of metal O-ring seals 15. The jacket 14 is secured to a gun tube 16 and serves to align the breech 10 with the gun tube bore. A loading chamber 18 is defined by the space between the jacket 14 and the breech 10. The The breech is provided with rows of circumferentially spaced fill orfices 19 which provide fluid communication between the loading chamber 18 and the annular combustion chambers 11.

In operation, the gun is breech loaded from the rear and a projectile 20 is positioned within the breech 10 as shown. The inner diameter of each flange 12 is the nominal bore diameter so that the flanges serve to support and guide the projectile within the breech 10. A metered quantity of liquid monopropellant is pumped into the loading chamber 18 from an external supply 21 and flows through the filling orifices 19 into each annular combustion chamber 11. Air or residual combustion product gases are vented along the surface of the projectile and through a vent check valve (not shown) at the forward end of the combustion chamber. The vent check valve remains open during the low pressure filling cycle but closes during the high pressure combustion cycle. The metal O-ring seal 15 at each end of the combustion chamber is employed to prevent the propellant from draining into the bore.

The gun is fired by igniting a small primer charge 22 (solid or liquid) introduced with and at the base of the projectile 20 during the loading cycle. The gas pressure produced in the small initial volume behind the projectile forces the projectile forward until the first small annular combustion chamber 11 is exposed. The surface of the propellant therein is ignited by the hot ignition gases. Since the volume of each discrete annulus is small, the combustion process within it is quickly completed. Only the propellant contained inside the annulus is consumed because the small size of the fill orifices 19 prevents the propagation of the flame front into the loading chamber.

As the projectile 20 continues to move along the bore, a wedge-shaped plastic obturation ring 24 sequentially exposes an increasing number of annular combustion chambers to be ignited at a rate which is proportional to the projectile velocity. Thus the gas production rate is directly coupled to and therefore effectively metered by the projectile acceleration, which is a function of the constant projectile mass. The ballistic pressure very quickly attains a constant value which is a function of the volume of each small annular combustion chamber. Constant pressure acceleration of the projectile continues until the total volume of propellant within the combustion chamber has been consumed, which occurs shortly after the base of the projectile passes into the gun tube 16. Thereafter the projectile is accelerated until ejection from the muzzle occurs, while the bore pressure drops off in the usual fashion due to the expansion of the propellant gases.

From the foregoing, it will be readily apparent that the present invention possesses numerous advantages not found in prior art devices. The principle advantage of this invention is that it provides the means for achieving precision control of the combustion processes in a liquid monopropellant gun. By separating a given bulk of propellant into a large number of small discrete volumes during ignition, it is possible to eliminate the hydrodynamic instabilities usually associated with the combustion of bulk loaded propellant. This occurs because the total combustion of each small volume is completed before instabilities have a chance to develop. Since the combustion process in each small annular combustion chamber proceeds in effective isolation and independence from the others, the growth and propagation of such instabilities as the Taylor and Helmholtz variety are precluded.

A second primary advantage of this invention is that it provides the means for incorporating the propellant lined breech concept within the liquid monopropellant gun. By arranging each small annular combustion chamber in series along the interior surface of the breech wall, it becomes possible to directly couple the propellant burning surface area development during combustion to the motion of the projectile in the bore. This circumstance not only results in an optimum piezometric effeciency but also ensures a high degree of reproducibility to the firing impulse and therefore the projectile muzzle velocity. An essential new feature of this invention is the design of the compartmented combustion chamber to achieve the type of operation described.

Further advantages to be derived from the successful application of liquid monopropellants in guns are numerous. Some important benefits to be gained generally pertain to the following:

1. Increased ballistic performance due to the fact that liquid propellants are usually more dense and more energetic than conventional solid gun propellants, producing higher muzzle velocities with greater efficiency.

2. Extended barrel life, increased reliability, and lower weapon system cost due to dramatically reduced gas erosion effects which in turn result from the low combustion temperature and ablative bore surface protection inherent in the use of liquid propellants.

3. Ultimate system design simplicity to be derived from the elimination of cartridge cases, lower total system weight, less complex ammunition handling systems, etc.

Certain alternatives, such as those following, will immediately suggest themselves to those skilled in the art.

In order to prevent the liquid propellant which has been pumped into the combustion chamber from draining into the bore prior to firing, it may be preferable to employ a liquid monopropellant in the form of a thixotropic gel. A thixotropic gel or thixotropic has the properties of a highly viscous liquid or stiff jelly unless and until is forced under pressure through a pipeline or injector. Under these conditions its viscosity drops precipitously and it flows like an ordinary liquid, until the pressure is released and the liquid reverts again to a gel. Use of gelled monopropellants in the present gun would eliminate the need for the metal O-ring. In addition, the use of gelled monopropellants is desirable from the standpoint of reducing the leakage hazard throughout the propellant handling system, and also because a gelled fuel is much less a fire hazard if it is inadvertently spilled.

The introduction of a solid propellant igniter charge attached to the base of the projectile offers precision yet flexibility in establishing the early stages of ignition. An alternative approach would be to alter the combustion chamber geometry slightly to permit a predetermined amount of liquid propellant to flow into the space behind the projectile and serve as the igniter charge. This is a somewhat less flexible arrangement, but it would increase the design simplicity of the system. This arrangement may also prove particularly attractive when coupled with a pulsed laser ignition system designed to ignite the monopropellant directly.

Obviously many other modifications and variations of the present invention are possible in the light of the above teachings. It is therefore to be understood that within the scope of the appended claims, the invention may be practiced otherwise than as specifically described.

What is claimed is:

1. A liquid monopropellant gun having a propellant lined breech when ready for firing comprising:

a gun tube;

a breech fixed to one end of said gun tube;

a plurality of annular combustion chambers formed on the interior wall of said breech, the interior wall of each of said combustion chambers being defined by the surface of a projectile introduced into said breech; and means for introducing liquid monopropellant into said annular combustion chambers.

2. A gun as defined in claim 1 wherein said propellant introducing means includes:

a jacket surrounding said breech and spaced therefrom to define a loading chamber therebetween; and at least one fill orifice formed in said breech to provide fluid communication between each annular combustion chamber and said loading chamber, said fill orifices being of sufficiently small diameter to preclude propagation of a flame front from said combustion chambers into said loading chamber.

3. A gun as defined in claim 2 wherein said propellant introducing means further includes:

a propellant reservoir; and means for pumping liquid monopropellant from said reservoir into said loading chamber and through said fill orifices into said annular combustion chambers.

4. A gun as defined in claim 1 wherein said annular combustion chambers are defined by a plurality of inwardly projecting flanges formed integrally with said breech and having an inner diameter equal to the nominal diameter of the projectile whereby sequential ignition of discrete volumes of propellant is obtained as the projectile moves along the breech toward the gun tube, the rate of ignition being governed by projectile velocity.

5. A gun as defined in claim 4 wherein said propellant introducing means includes:

a jacket surrounding said breech and spaced therefrom to define a loading chamber therebetween; and at least one fill orifice formed in said breech to provide fluid communication between each annular combustion chamber and said loading chamber, said fill orifices being of sufficiently small diameter to preclude propagation of a flame front from said combustion chambers into said loading chamber.

6. A gun as defined in claim 5 wherein said propellant introducing means further includes:

a propellant reservoir; and means for pumping liquid monopropellant from said reservoir into said loading chamber and through said fill orifices into sid annular combustion chambers.

* * * * *